US005966818A

United States Patent [19]

Spirer

[11] Patent Number: 5,966,818

[45] **Date of Patent: *Oct. 19, 1999**

[54] CHISEL WITH IMPROVED BLADE

[76] Inventor: Steven E. Spirer, 391 Haworth Ave., Haworth, N.J. 07641

[ * ] Notice: This patent issued on a continued prosecution application filed under 37 CFR 1.53(d), and is subject to the twenty year patent term provisions of 35 U.S.C. 154(a)(2).

[21] Appl. No.: 08/736,969

[22] Filed: Oct. 25, 1996

[51] Int. Cl.[6] ..... B25D 3/00; B25G 1/00; B25G 3/00

[52] U.S. Cl. ..... 30/167; 30/340; 30/344; 30/353

[58] Field of Search ..... 30/344, 340, 260, 30/167, 353; 83/955

[56] References Cited

U.S. PATENT DOCUMENTS

| | | | |
|---|---|---|---|
| 393,880 | 12/1888 | Binkerd . | |
| 740,937 | 10/1903 | Smith . | |
| 855,834 | 6/1907 | Bubb . | |
| 1,076,900 | 10/1913 | McNeil . | |
| 1,082,802 | 12/1913 | Full . | |
| 1,493,176 | 5/1924 | Wood | 30/167 |
| 1,634,120 | 6/1927 | Schrade | 30/353 |
| 1,903,877 | 4/1933 | Potter | 30/353 |
| 1,945,810 | 2/1934 | Holtz . | |
| 2,364,481 | 12/1944 | Seiler . | |
| 2,494,455 | 1/1950 | Soldani | 30/353 |
| 2,650,422 | 9/1953 | Soltow et al. | 30/353 |
| 2,662,287 | 12/1953 | Ferguson | 30/353 |
| 5,001,796 | 3/1991 | Desjardins | 30/125 |
| 5,054,201 | 10/1991 | Andrews . | |
| 5,197,194 | 3/1993 | Sorensen et al. | 30/260 |
| 5,636,845 | 6/1997 | Newnam | 30/353 |

FOREIGN PATENT DOCUMENTS

| | | | |
|---|---|---|---|
| 5877 | of 1896 | United Kingdom | 30/167 |

*Primary Examiner*—Rinaldi I. Rada
*Assistant Examiner*—Sean Pryor
*Attorney, Agent, or Firm*—Weingram & Associates, Inc.

[57] ABSTRACT

A chisel with a removably mountable blade is provided which consists of a handle for the chisel having a head region formed with a detent to provide a space for receiving a first cutting edge of the blade, while the other opposed cutting edge of the blade is arranged for a cutting operation. The space provided by the detent in the head region is constructed and arranged to prevent the cutting edge in the detent from contacting the handle portion during a chiseling operation, thereby preventing dulling of the edge prior to it being pivoted into position for a subsequent cutting operation. The blade is provided with a transverse axis at opposed sides of which are arranged a cutting portion and a rake, which cutting portion and rake are asymmetrical to the cutting portion and rake at the opposite side of the transverse axis of the blade.

11 Claims, 3 Drawing Sheets

10
A
B
C
12
14
18
20
22
24
26
28
30
30a
30b
32
32a
32b
34
34a
34b
44
44
46
46
48
50

CHISEL WITH IMPROVED BLADE

BACKGROUND OF THE INVENTION

1. Field of the Invention

The present invention relates to chisels and in particular, chisels which have a reversible, interchangeable blade and a rake extending along a side of the blade to facilitate movement of the blade through a work piece material.

2. Related Art

Hand operated tools are known to chip, chisel, scrape, etc. various types of work piece materials. The blades of such tools have a sharp edge to work the material. Known devices are described in:

| U.S. Pat. No. | Inventor(s) |
|---|---|
| 393,880 | Binkerd |
| 740,937 | Smith |
| 855,834 | Bubb |
| 1,076,900 | Mc Neil |
| 1,082,802 | Full |
| 1,945,810 | Holts |
| 2,364,481 | Seiler |
| 5,054,201 | Andrews |

U.S. Pat. No. 5,393,880 to Binkerd discloses a gage chisel for cutting hinge recesses.

U.S. Pat. No. 740,937 to Smith discloses a chisel having a bayonet type clamp to mount the cutting bit. Guides protect an end to the chisel which is a single, replaceable blade.

U.S. Pat. No. 855,834 to Bubb discloses a carpenter's tool with an irreversible blade.

U.S. Pat. No. 1,076,900 to McNeil discloses a chisel gage having a replaceable, non reversible, blade.

U.S. Pat. No. 1,082,802 to Full, discloses a scraping tool. The blade disclosed in Full is held by the pressure of a thumb screw against retaining dogs.

U.S. Pat. No. 1,945,810 to Holtz discloses a pavement crack clearing device.

U.S. Pat. No. 2,364,481 to Seiler discloses a shear developer.

U.S. Pat. No. 5,054,201 to Andrews discloses a deburring tool, not a chisel, with cutting edges of the blades disposed at the intersection of a top and sides of the blades.

Among the devices disclosed in the foregoing patents, none disclose a chisel having a blade which is removably mountable thereto and constructed in asymmetrical form about a transverse axis to conform to the chisel handle which is adapted to receive and retain the blade during operation.

OBJECTS AND SUMMARY OF THE INVENTION

It is an object of the present invention to provide a chisel with an improved cutting head.

It is another object of the present invention to provide a chisel with a pronounced finger guard.

It is another object of the present invention to provide a chisel having a handle with portions removed therefrom to reduce the weight of the chisel and to provide a plurality of regions in which indicia can be formed and displayed free from abrasion.

It is another object of the present invention to provide a chisel with a head portion constructed to receive the blade which is removably mountable thereto.

It is another object of the present invention to provide a chisel with a head portion formed with a detent to receive and retain a portion of the blade in a spaced-apart relationship with the head portion.

It is another object of the present invention to provide a chisel with a head portion formed with a detent to positively retain and prevent movement of the blade during a cutting operation.

It is another object of the present invention to provide a chisel with a head portion constructed with a surface area having a grade substantially similar to a grade along a cutting edge of the blade.

It is a another object of the present invention to provide a chisel with a blade that is constructed with asymmetrical proportions at opposed sides of a transverse axis of the blade.

It is another object of the present invention to provide a chisel with a head portion constructed with recesses in which mounting members are disposed to releasably engage the blade to the head portion.

It is another object of the present invention to provide a blade with a rake along longitudinal side edges of the blade between opposed sharpened work edges of the blade.

It is a further object of the present invention to form a handle of the chisel as a forged member of uniform construction.

The chisel with improved blade according to the present invention includes a removably mountable blade and a handle having a head region formed with a detent to provide a space for receiving a first cutting edge of the blade, while the other opposed cutting edge of the blade is arranged for a cutting operation. The space provided by the detent in the head region is constructed and arranged to prevent the cutting edge in the detent from contacting the handle portion during a chiseling operation, thereby preventing dulling of the edge prior to it being pivoted into position for a subsequent cutting operation. The blade is provided with a transverse axis at opposed sides of which are arranged a cutting portion and a rake, which cutting portion and rake are asymmetrical to the cutting portion and rake at the opposite side of the transverse axis of the blade.

BRIEF DESCRIPTION OF THE DRAWINGS

For a more complete understanding of the present invention, reference may be had to the following detailed description of the present invention taken in connection with the following drawings, of which.

DETAILED DESCRIPTION OF THE INVENTION

Referring to FIGS. 1–4, a chisel 10 of the present invention includes a handle portion 12 and a blade 14 removably mountable to the handle portion 12 by mechanical fasteners such as screws 16.

Figure 1:
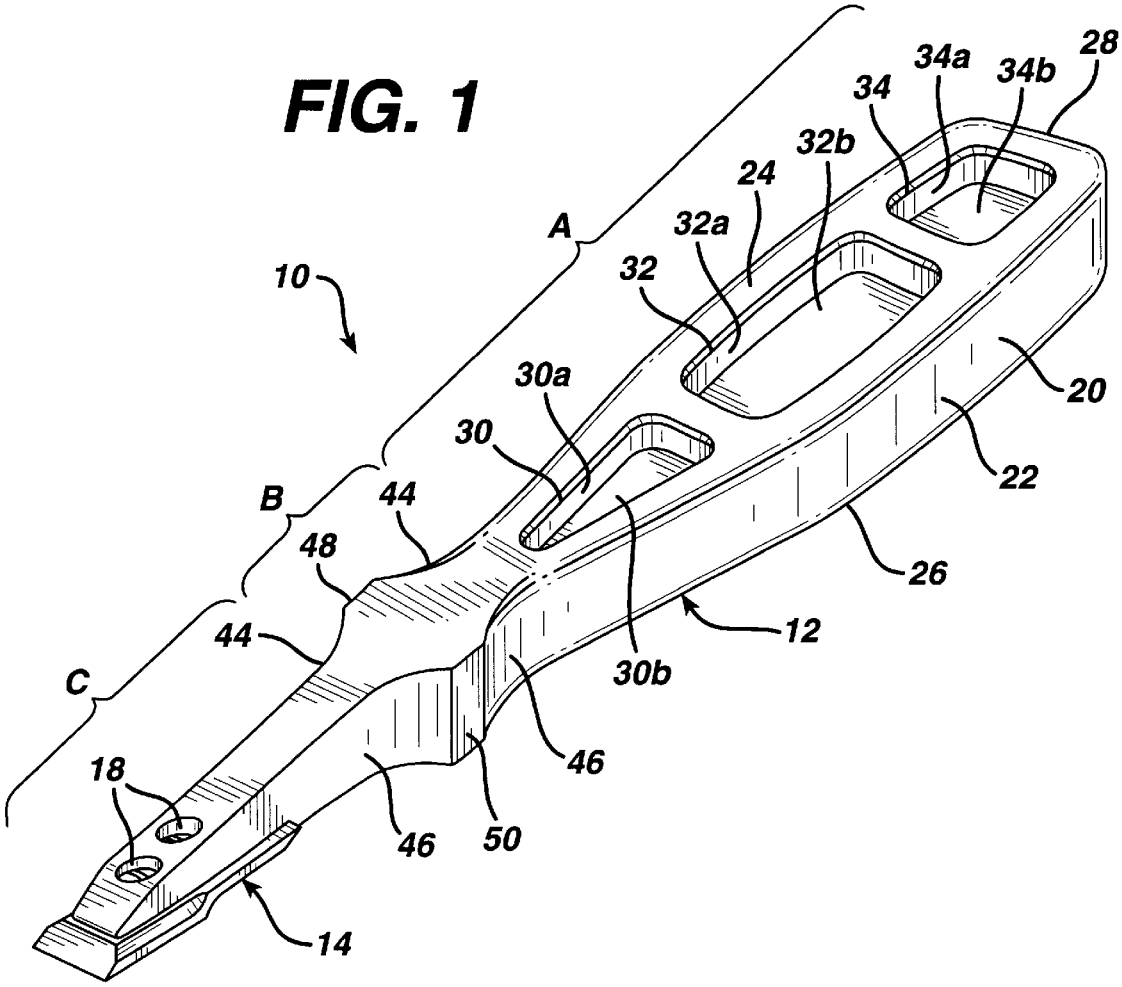
FIG. 1 is a perspective view showing a chisel with improved blade according to the present invention.

In particular, referring to FIG. 1, the handle includes a grip region A extending to a guard region B which terminates in a front or head region C. The head region C is bored out with a pair of holes 18 extending completely through the head region C in which the screws 16 are received.

A sidewall 20 of the chisel 10 extends continuously along the grip, guard and head regions A–C, respectively, and is formed as a uniform continuous surface. Alternatively, the sidewall 20 can be formed with a plurality of separate, spaced-apart grooves 22 to facilitate holding the grip region A. The sidewall can also be knurled or machined to facilitate gripping. The sidewall 20 interconnects an upper surface 24, a lower surface 26 and an end portion 28 of the chisel 10. The upper surface 24 and lower surface 26 are smooth and provided with a gentle chamfer where the upper surface 24 and the lower surface 26 meet the sidewall 20. The end portion 28 is located at that portion of the sidewall opposite to the head region C of the handle 12.

Figure 2:
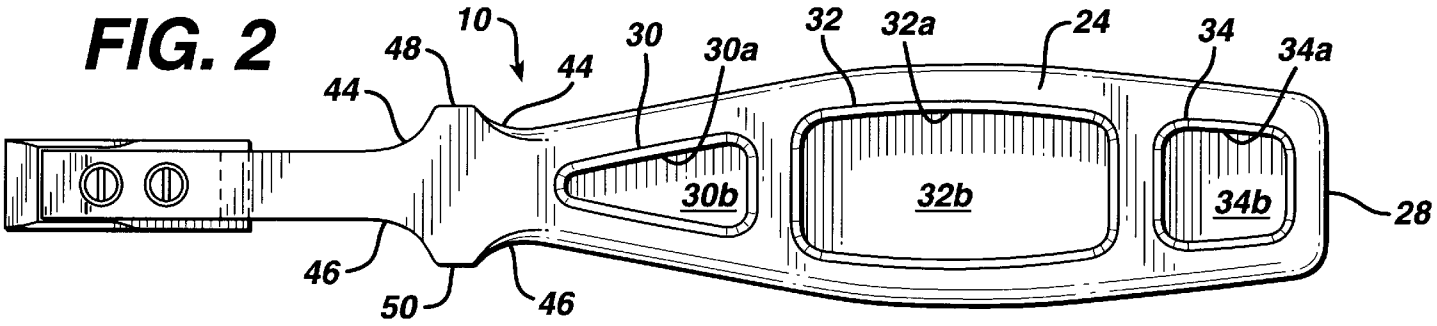
FIG. 2 is a top plan view thereof.
Figure 3:
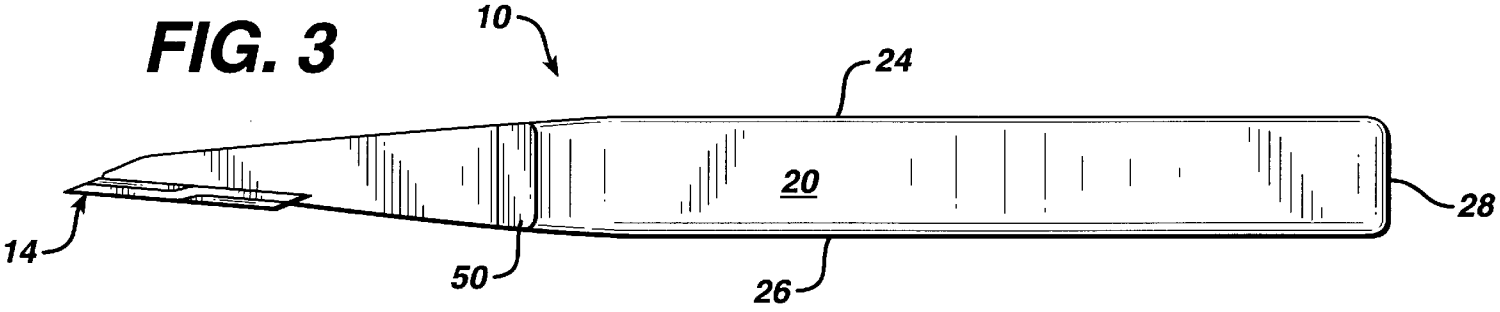
FIG. 3 is a side elevational view thereof, the opposite side being a mirror image.
Figure 4:
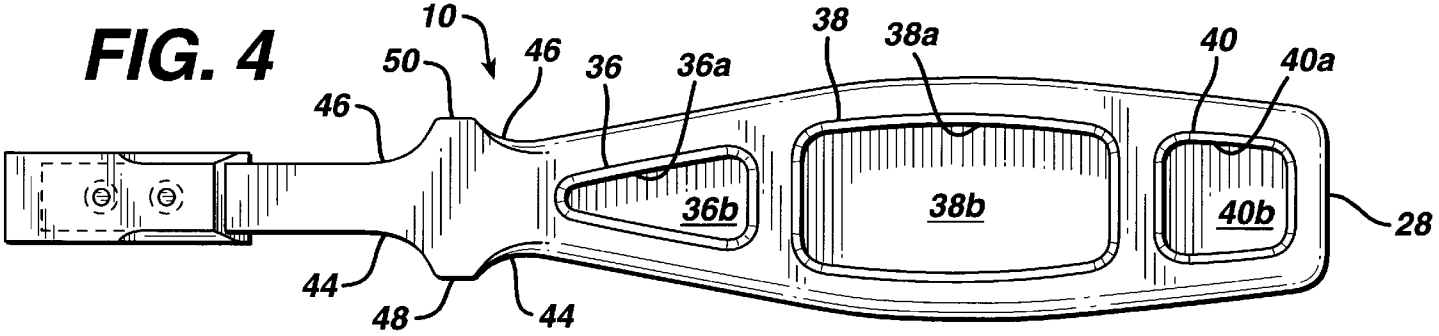
FIG. 4 is a bottom plan view thereof.

Referring also to FIGS. 2 and 4, a plurality of depressions or recesses 30,32,34 are formed in the upper surface 24 of the handle 12. Each one of the recesses 30,32,34 in the handle 12 is formed by removing a portion of the handle at the upper surface 24 so that a depressed wall 30*a*,32*a*,34*a* is formed extending downward into the handle to a corresponding floor 30*b*,32*b*,34*b*. The recesses 30,32,34 are preferably formed to extend into the handle to a common depth. Referring to FIG. 4, a corresponding construction of a plurality of depressions or recesses 36,38,40 is formed at the lower surface 26 of the handle opposite to that of the upper surface 24. The recesses 36,38,40 are formed in the handle 12 in registration to a corresponding one of the recesses 30,32,34, respectively, at the upper surface 24 of the handle. In particular the recesses 36,38,40 are each formed in the lower surface 26 of the handle 12 by removing a portion of the lower surface 26 so that a depressed wall 36*a*,38*a*,40*a* is provided to extend from the lower surface 26 of the handle 12 into the handle 12 to a floor 36*b*,38*b*,40*b*. The recesses 36,38,40 are preferably formed to extend into the handle to a common depth.

Constructing the upper surface 24 and lower surface 26 of the handle 12 with these depressions necessitates removal of portions of the handle 12 and therefore, reduces the weight of the chisel. In addition, the recesses provide for the depressed floors 30*b*,32*b*,34*b*,36*b*,38*b*,40*b* on which indicia can be formed, such as logos, notices, warnings, graphic indicia 42, etc., which because this indicia is below and removed from the upper and lower surfaces 24,26, the indicia is less likely to be abraded or worn off as a result of the chisel 10 being gripped.

Referring to FIGS. 1,2,4 the guard region B of the chisel 10 is constructed to provide a guard or shielding portion for the user's fingers and hand during use, and an area upon which leverage can be applied by the user. As shown, the sidewall 20 at opposed sides of the handle 12 flares outward at 44,46 to a corresponding oblate portion 48,50, against which the user's fingers will rest when force is being applied to the chisel 10. The oblate portions 48,50 extend outward from the sidewall 20 to a distance further than the head region C and blade 14 removably mounted thereto.

Figure 5:
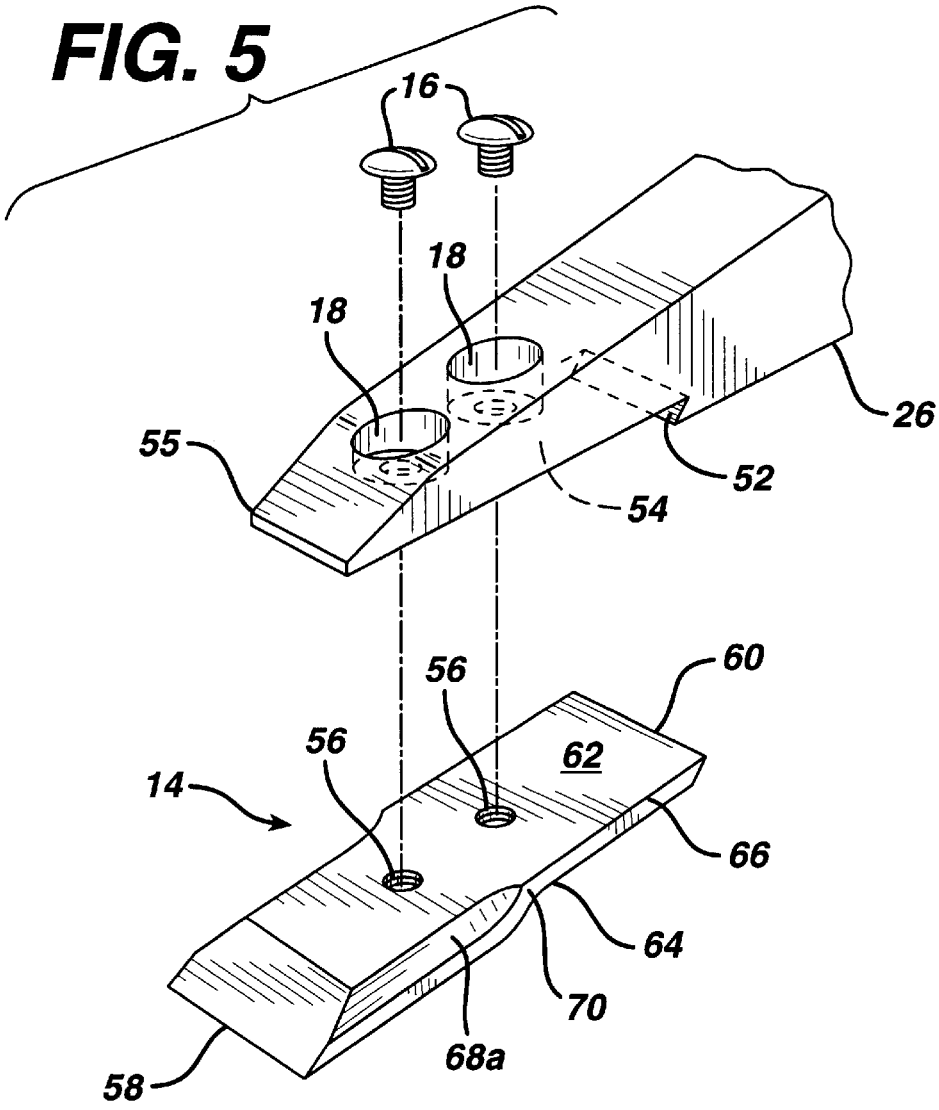
FIG. 5 is an exploded perspective view of a head portion of the chisel and the blade.
Figure 6:
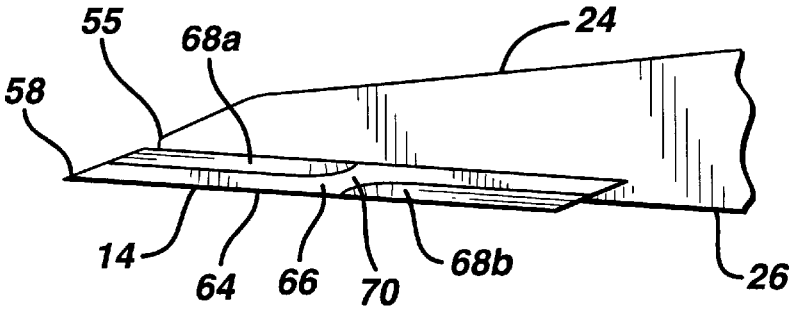
FIG. 6 is an enlarged side view of the head portion of the chisel with the blade removably mounted thereto.

Referring also to FIGS. 5,6, the construction of the head region C of the handle 12 is more particularly shown, as is the manner in which the blade 14 is removably mounted thereto. As shown in FIG. 5, the lower surface 26 of the handle 12 is a planar surface which at the head region C is provided with a cutout or detent 52 which functions as a step portion from which the lower surface 26 extends in a different plane. This step portion of the lower surface 26 is shown at 54. The purpose of the detent 52 will be described hereinafter. The holes 18 formed in the upper surface 24 extend through the head region C through to the planar surface 54. The sidewall 20, and the upper surface 24 taper at the head region C toward a terminus 55 of the head region C.

The blade 14 of the chisel 10 is formed with a pair of apertures 56 which extend through the blade and are spaced apart for registration with a corresponding one of the holes 18 of the head region C. The blade 14 is formed with a pair of opposed cutting edges 58,60 which are asymmetrical with respect to each other. The cutting edges 58,60 are each sized and shaped to be disposed in and received by the detent 52 in the head portion C of the handle 12. The detent 52 provides a positive seat in which one of the cutting edges 58,60 not in use is disposed and retained during a cutting operation.

Preferably, the size and shape of the detent 52 is such that the cutting edge 58,60 does not at all contact the head region C at the detent 52. The provision for clearance in the detent 52 between the edge 58,60 and the head region C prevents the edge 58, 60 from contacting the head region C and becoming dull during the chiseling operation.

An upper surface 62 and a lower surface 64 of the blade 14 are each substantially flat, and are interconnected by a continuous side edge 66. The continuous side edge 66 is provided with a corresponding rake portion 68*a* where the side edge 66 tapers upward to the upper surface 62 of the blade 14. The side edge is also formed with a rake 68*b* where the side edge 66 continues to the lower surface 64 of the blade 14. The rakes 68*a*,68*b* extend in opposite directions to their respective upper surface 62 and lower surface 64 at opposite sides of the transverse center line 70 of the blade. Similarly, and particularly with reference to FIG. 5, the upper surface 62 has a corresponding end portion which angles downward at a particular incline to terminate at the cutting edge 58. The lower surface 64 is also formed with an angled end portion which is angled upward to terminate in the cutting edge 60.

Therefore, regardless of which one of the cutting edges 58,60 is used during a chiseling operation, the cutting edge 58,60 being used will have its corresponding rake 68*a*,68*b* positioned to facilitate movement of the blade through the material being chiseled.

The terminus 55 of the head region C is constructed and arranged with a grade or an incline similar to that formed on the upper and lower surfaces 62,64 of the blade 14, where such surfaces are angled to terminate in a corresponding one of the cutting edges 58,60. As shown in FIG. 6, the upper surface 24 at the head region C tapers downward and is slightly angled just before the terminus 55 of the head region C. The portion of the upper surface 24 just before the terminus 55 is at an angle substantially similar to, and preferable equal with, the angle formed in the upper surface 62 of the blade 14 just before the cutting edge 58. A similar structure is also provided for the lower surface 64 of the blade 14, in that when the blade 14 is pivoted to bring the cutting edge 60 into position for a chiseling operation, the angle of the lower surface 64 of the blade 14 just before the cutting edge 60 is of an angle similar to that of the upper surface 24 just before the terminus 55.

The upper surface 62 and the lower surface 64 are smooth so that the respective surface will lie flush against the planar surface 54. A flush fit of the upper surface 62 and the lower surface 64 when each is disposed against the planar surface 54 substantially reduces if not eliminates any sort of vibration or displacement of the blade 14 from the head region C during a chiseling operation. In addition, and by way of example of having the upper surface 62 flush against the planar surface 54, this provides for the grade at the head region C and the grade of the upper surface 62 extending to the cutting edge 58 to conform with each other as shown in FIG. 6. This construction and arrangement of the blade 14 with respect to the head region C further facilitates movement of the head region C and the blade 14 through the work piece material. In effect, the work piece material is sluffed off and does not impinge on the head region C of the handle portion 12.

In operation, and referring to FIGS. 5 and 6, the cutting edge 60 is disposed in the detent 52 and seated so that the upper surface 62 of the blade 14 is flush against the planar surface 54 of the head region C. The screws 16 are disposed in the holes 18 to extend through and into a corresponding one of the apertures 56 of the blade 14, after which the screws 16 are turned down for tightening. The detent 52 in the handle 12 positively retains the blade to reinforce the position of the blade 14 with respect to the head region C of the handle 12, especially during a cutting operation or when the end portion 28 of the handle 12 is being hammered. The rake 68*a* of the blade 14 permits the blade 14 to move through the object or material being chiseled, i.e. without the rake 68*a*, the blade would bind and become wedged in the material during the chiseling operation being performed. When the cutting edge 58 becomes dull, the screws 16 are backed-off to remove the blade 14 and the blade turned over and pivoted 180° so that the cutting edge 60 is positioned for use as the working edge. The cutting edge 58 is seated in the detent 52 and the surface 64 is disposed flush with the planar surface 54. The screws 16 are then tightened and the user can commence subsequent chiseling operations.

There is no wasted time sharpening the blades 14, when both cutting edges 58,60 are no longer usable. Used blades are discarded and another blade 14 is removably mounted to the head portion C of the handle 12. The blades 14 can be indexed to indicate different sizes for different chiseling operations.

The chisel 10 is preferably forged and can be manufactured of a high strength aluminum which can withstand hammering for those chiseling operations that require such.

It is understood that the embodiments described herein are merely exemplary and that a person skilled in the art may make many variations and modifications without departing from the spirit and scope of the invention. All such embodiments, modifications and variations are intended to be included within the scope of the invention as defined in the appended claims.

What is claimed is:

1. A chisel, comprising:

a handle, comprising:

a first surface extending to a front portion of said handle, a second surface opposed to said first surface and extending to said front portion, a continuous sidewall interconnecting said first surface with said second surface, a pair of apertures formed in said front portion of said handle, said apertures extending from said first surface to said second surface, mounting screws constructed and arranged to coact with said pair of apertures, a pair of protrusions spaced apart at opposed sides of said handle and extending from said continuous sidewall, at least one recess formed in each of said first surface and said second surface for displaying indicia at each of said first surface and said second surface, a detent formed in said second surface and constructed and arranged to face said front portion of said handle for providing a cutout portion at said second surface; and a blade removably mountable to said second surface of said handle, said blade comprising:

a longitudinal member having a transverse axis and opposed mounting surfaces, each one of said opposed mounting surfaces having a substantially smooth surface area adapted for being mounted flush along the second surface of the handle extending from the detent toward said front portion of said handle, a pair of mounting apertures formed in said longitudinal member in registration with said pair of apertures at said front portion of said handle for releasably receiving said mounting screws, a first cutting portion extending from a first side of said transverse axis to a first cutting edge, said first cutting edge having a first grade similar to a grade of said first surface at said front portion, a second cutting portion extending from a second side of said transverse axis to a second cutting edge opposite to and asymmetrical with said first cutting portion, said second cutting edge having a second grade similar to said grade of said first surface at said front portion, a peripheral edge extending along said longitudinal member and interconnecting said first and second cutting portions, a first rake region extending from said peripheral edge at said first cutting portion, and a second rake region extending from said peripheral edge at said second cutting portion and asymmetrical with said first rake region, wherein one of said first or second cutting edges is disposed in said cutout portion and spaced apart from said second surface at said detent, and the other of said cutting edges extends from said front portion for cutting.

2. A chisel, comprising:

a handle portion having:

a top, a bottom, a continuous sidewall connecting, said top and said bottom, a detent formed in said bottom, a cutting member removably mountable to said bottom of said handle portion, said cutting member comprising:

opposed mounting surfaces, each one of said opposed mounting surfaces having a substantially smooth surface area adapted for being mounted flush along the bottom of the chisel extending from the detent along the bottom of said handle, and opposed cutting edges, each one of said opposed cutting edges adapted to be disposed in said detent and spaced apart from said bottom at said detent when the other of said opposed cutting edges is cutting.

3. The chisel according to claim 2, further comprising:

a mounting region formed in a front portion of said chisel, said mounting region extending from said top through to said bottom, and mounting members constructed and arranged to coact with said mounting region.

4. The chisel according to claim 3, wherein said mounting region comprises:

a pair of apertures formed in said front portion of the chisel, and said mounting members comprise:

a pair of screws for coacting with a respective one of said mounting apertures.

5. The chisel according to claim 2, further comprising:

a pair of protrusions spaced apart at opposed sides of said chisel and extending from said continuous sidewall.

6. The chisel according to claim 2, further comprising:

a display region formed in said top and said bottom of said chisel on which indicia is displayed.

7. The chisel according to claim 6, wherein the display region comprises:

at least one recess formed in each of said top and said bottom for displaying said indicia at said top and said bottom.

8. The chisel according to claim 4, wherein said cutting member comprises:

a longitudinal member having a transverse axis, a pair of mounting apertures in said longitudinal member in registration with said pair of apertures at a front portion of said chisel for releasably receiving said mounting screws, a first cutting portion extending from a first side of said transverse axis to a first cutting edge, said first cutting edge having a first grade similar to a grade of said first surface at said front portion, a second cutting portion extending from a second side of said transverse axis to a second cutting edge opposite to and asymmetrical with said first cutting portion, said second cutting edge having a second grade similar to said grade of said first surface at said front portion, and a peripheral edge extending along said longitudinal member and interconnecting said first and second cutting portions.

9. The chisel according to claim 8, further comprising:

a first rake region extending from said peripheral edge at said first cutting portion, and a second rake region extending from said peripheral edge at said second cutting portion, said second rake region asymmetrical with said first rake region.

10. The chisel according to claim 5, wherein said protrusions are formed intregal with said chisel.

11. A chisel, comprising:

a handle, comprising:

a first surface extending to a front portion of said handle, a second surface opposed to said first surface and extending to said front portion, a continuous sidewall interconnecting said first surface with said second surface, a pair of apertures formed in said front portion of said handle, said apertures extending from said first surface to said second surface, mounting screws constructed and arranged to coact with said pair of apertures, a pair of protrusions spaced apart at opposed sides of said handle and extending from said continuous sidewall, at least one recess formed in each of said first surface and said second surface for displaying indicia at each of said first surface and said second surface, a detent formed in said second surface and constructed and arranged to face said front portion of said handle for providing a cutout portion at said second surface; and a blade removably mountable to said second surface of said handle, said blade comprising:

a longitudinal member having:

a transverse axis, a top surface, a bottom surface opposed to said top surface, each one of said top surface and bottom surface adapted for being mounted flush to said second surface extending from the detent toward said front portion of said handle, a pair of mounting apertures formed in said longitudinal member in registration with said pair of apertures at said front portion of said handle for releasably receiving said mounting screws, a first cutting portion extending from a first side of said transverse axis to a first cutting edge, said first cutting edge having a first grade similar to a grade of said first surface at said front portion, a second cutting portion extending from a second side of said transverse axis to a second cutting edge opposite to and asymmetrical with said first cutting portion, said second cutting edge having a second grade similar to said grade of said first surface at said front portion, a peripheral edge extending along said longitudinal member and interconnecting said first and second cutting portions, a first rake region extending from said peripheral edge at said first cutting portion, and a second rake region extending from said peripheral edge at said second cutting portion and asymmetrical with said first rake region, wherein one of said first and second cutting edges is disposed in said cutout portion and spaced apart from said second surface at said detent, and the other of said cutting edges extends from said front portion for cutting.

* * * * *